US010332385B2

(12) United States Patent
Knechtel et al.

(10) Patent No.: US 10,332,385 B2
(45) Date of Patent: Jun. 25, 2019

(54) LOCATION BASED SUPPORT REQUEST MESSAGES RESPONSIVE TO ALERT RECOMMENDATION

(71) Applicant: SAP SE, Walldorf (DE)

(72) Inventors: Martin Knechtel, Dresden (DE); Axel Schroeder, Dresden (DE)

(73) Assignee: SAP SE, Walldorf (DE)

( * ) Notice: Subject to any disclaimer, the term of this patent is extended or adjusted under 35 U.S.C. 154(b) by 24 days.

(21) Appl. No.: 15/359,782

(22) Filed: Nov. 23, 2016

(65) Prior Publication Data

US 2018/0144614 A1 May 24, 2018

(51) Int. Cl.
*G08B 27/00* (2006.01)

(52) U.S. Cl.
CPC ..... *G08B 27/006* (2013.01)

(58) Field of Classification Search
CPC ..... G01C 21/20; G01C 21/34; G01C 21/362; H04W 4/021; H04W 4/023; H04W 4/22
See application file for complete search history.

(56) References Cited

U.S. PATENT DOCUMENTS 8,559,914 B2 * 10/2013 Jones ..... H04W 4/90 455/404.2
2011/0117878 A1 * 5/2011 Barash ..... G08B 21/0211 455/404.2
2015/0022338 A1 * 1/2015 Hwang ..... G08B 25/10 340/501
2015/0319294 A1 * 11/2015 Sudhir ..... H04M 1/72541 455/411

* cited by examiner

*Primary Examiner* — Omeed Alizada
(74) *Attorney, Agent, or Firm* — Buckley, Maschoff & Talwalkar LLC

(57) ABSTRACT

A set of condition monitoring sensors may provide signals indicative of current conditions local at a user device (e.g., a smartphone). An alert recommendation platform may automatically analyze the signals and decision logic to generate an alert recommendation and output an alert signal. Responsive to the alert signal, a notification platform may automatically determine a set of potential support communication devices (e.g., other smartphones) based at least in part on a location associated with the user device and locations of the potential support communication devices. The notification platform may then arrange for at least some of the potential support communication devices to receive a support request message (e.g., nearby smartphones may receive notifications requesting support).

21 Claims, 16 Drawing Sheets

1600

| SUPPORT REQUEST MESSAGE ID 1602 | SENSOR(S) 1604 | DESCRIPTION 1606 | LOCATION 1608 | POTENTIAL SUPPORT COMMUNICATION DEVICES 1610 |
|---|---|---|---|---|
| SRM_101 | S_101; S_102 | POSSIBLE HEART ATTACK | LAT/LONG | 3 SMARTPHONES |
| SRM_102 | S_101 | IRREGULAR HEARTBEAT | CELL TOWER | 2 VEHICLE SYSTEMS |
| SRM_103 | S_103 | LOW GLUCOSE LEVEL | STREET ADDRESS | 1 SMARTWATCH AMBULANCE |
| SRM_104 | S_104' S_105 | USER BEATEN AND MUGGED | LAT/LONG | 2 SMARTPHONES; POLICE DEPARTMENT |

*FIG. 16*

LOCATION BASED SUPPORT REQUEST MESSAGES RESPONSIVE TO ALERT RECOMMENDATION

FIELD

Some embodiments relate to systems and methods associated with mobile user devices. More specifically, some embodiments are directed to systems and methods to provide location based support request messages responsive to alert recommendations.

BACKGROUND

A user of a user device (e.g., a smartphone) may find that he or she suddenly and unexpectedly needs support from one or more other individuals. For example, a user might experience a medical event (e.g., a heart attack, stroke, etc.) and require immediate medical assistance. Similarly, user might be attacked and need the help of the police department. Typically, a user would use his or her smartphone to call for help from emergency services (e.g., by contacting the police, fire department, ambulance, etc.). In some cases, however, a user might be unable to use a smartphone (e.g., if he or she is unconscious or otherwise unable to speak or use the smartphone). Moreover, emergency service individuals might be located a substantial distance away from the user, and, as a result, the amount of time it would take them to respond to his or her request could be substantial.

Accordingly, methods and mechanisms to efficiently, accurately, and/or automatically facilitate location based support request messages responsive to alert recommendations may be provided in accordance with some embodiments described herein.

BRIEF DESCRIPTION OF THE DRAWINGS

FIG. 16 illustrates a portion of a support request database that might be stored in accordance with some embodiments.

DETAILED DESCRIPTION

Figure 1:
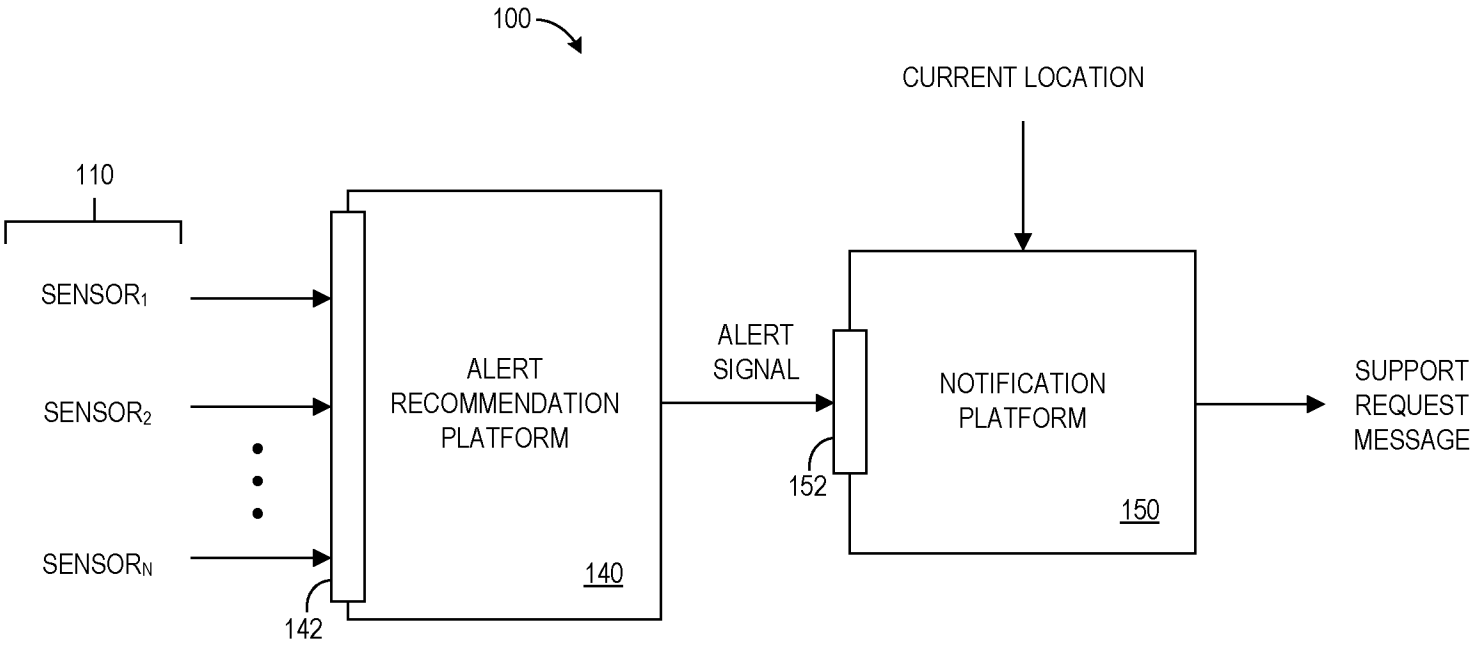
FIG. 1 is a block diagram of a system architecture according to some embodiments.

In some situations, a user of a user device, such as a smartphone, may find that he or she needs support from one or more other individuals. For example, a user might experience a medical event or be attacked and need rapid help from an ambulance, the police department, etc. Note that in some cases a user may be unable to use a smartphone or similar device (e.g., if he or she is unconscious). Moreover, the nearest emergency service individuals might be far away, the amount of time it would take them to respond to such a request could be substantial. To address such problems, FIG. 1 is a block diagram of a system 100 according to some embodiments. The system 100 might be associated with, for example, a user's smartphone. The system 100 includes an alert recommendation platform 140 that receives signals indicative of a current condition via a sensor communication port 142. The signals indicative of a current condition may be received from a set of condition monitoring sensors 110 (e.g. $\text{sensor}_1$, through $\text{sensor}_N$ as illustrated in FIG. 1). The signals might, for example, be associated with a user's heartbeat, movement (e.g., via an accelerometer), body temperature, etc. The alert recommendation engine 140 may analyze the received data and generate an alert signal when appropriate (e.g., when it is determined that the user might need assistance).

The alert signal may be received by a notification platform 150 via a recommendation communication port 152. The notification platform 150 may also receive or otherwise determine a user's current location. Based on this information, the notification platform 150 may transmit one or more support request messages to nearby individuals who are using communication devices. In this way, the nearby individuals may be able to provide support and/or assistance to the user in a timely fashion.

According to some embodiments, the notification platform 150 may directly communicate with one or more remote communication device via Bluetooth or the Internet. According to other embodiments, a gateway may be provided between the notification platform 150 and other remote devices. The other devices may include, according to some embodiments, one or more processors to receive electronic files and/or to execute applications and/or components (e.g., a plug-in that is integrated to a smartphone or tablet).

Note that FIG. 1 represents a logical architecture for the system 100 according to some embodiments, and actual implementations may include more or different components arranged in other manners. Moreover, each system described herein may be implemented by any number of devices in communication via any number of other public and/or private networks. Two or more of devices may be located remote from one another and may communicate with one another via any known manner of network(s) and/or a dedicated connection. Further, each device may comprise any number of hardware and/or software elements suitable to provide the functions described herein as well as any other functions. Other topologies may be used in conjunction with other embodiments.

Any of the devices illustrated in FIG. 1, including the alert recommendation platform 140, the notification platform 150, and remote communication devices may exchange information via any communication network which may be one or more of a Local Area Network ("LAN"), a Metropolitan Area Network ("MAN"), a Wide Area Network ("WAN"), a proprietary network, a Public Switched Telephone Network ("PSTN"), a Wireless Application Protocol ("WAP") network, a Bluetooth network, a wireless LAN network, and/or an Internet Protocol ("IP") network such as the Internet, an intranet, or an extranet. Note that any devices described herein may communicate via one or more such communication networks.

All systems and processes discussed herein may be embodied in program code stored on one or more computer-readable media. Such media may include, for example, a floppy disk, a CD-ROM, a DVD-ROM, magnetic tape, OR solid state Random Access Memory ("RAM") or Read Only Memory ("ROM") storage units. Embodiments are therefore not limited to any specific combination of hardware and software.

Figure 2:
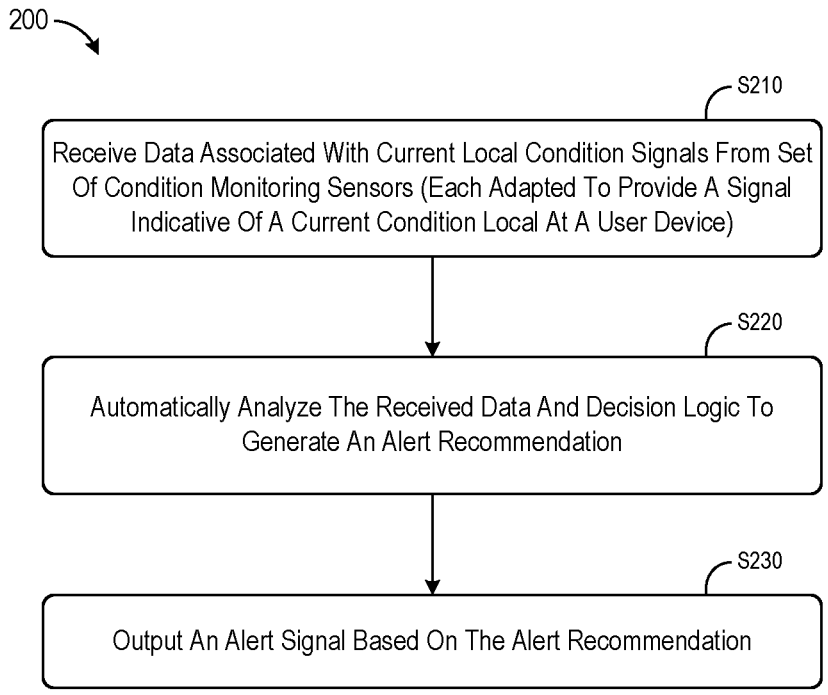
FIG. 2 is a flow diagram of an alert recommendation platform process in accordance with some embodiments.

According to some embodiments, the system may receive or determine a current location (e.g., based on Global Positioning System ("GPS") satellite information, cell phone tower information, etc.) and use that information, along with the alert signal from the alert recommendation engine, to output support request messages to nearby individuals. FIG. 2 is a flow diagram of an alert recommendation platform process 200 that might be associated with the illustration of the system 100 of FIG. 1 according to some embodiments. Note that all processes described herein may be executed by any combination of hardware and/or software. The processes may be embodied in program code stored on a tangible medium and executable by a computer to provide the functions described herein. Further note that the flow charts described herein do not imply a fixed order to the steps, and embodiments of the present invention may be practiced in any order that is practicable.

At S210, an alert recommendation platform may receive data associated with current local condition signals from a set of condition monitoring sensors. Each condition monitoring sensor may be, for example, adapted to provide a signal indicative of a current condition local at a user device. As used herein, the phrase "user device" may refer to, for example, a smartphone, an activity or fitness tracker, a smartwatch, a wearable computing device, a game or entertainment device, a music player, and/or a vehicle computer. Moreover, as used herein the phrase "condition monitoring sensor" might refer to devices associated with, for example, a smartphone, an activity or fitness tracker, a smartwatch, a wearable computing device, a vehicle computer (e.g., including device that transmit telematics data), a motion sensor, an accelerometer, a heart rate monitor, a blood pressure monitor, a glucose level monitor, skin resistance, a body temperature thermometer, a microphone (e.g., to detect an automobile crash, gunshot, etc.), a game or entertainment device, a music device, a location device (e.g., a navigation assistance apparatus), and/or any other diagnostic device or tool.

At S220, the system may automatically analyze the received data and decision logic to generate an alert recommendation. According to some embodiments, the decision logic is based on historic information associated with other user devices. For example, the system may learn over time which sets of sensor input conditions are typically associated with emergencies (and which are not). In other embodiments, the decision logic may be based on past interactions with the user device (e.g., and/or a user associated with the user device). For example, a system might learn information about a user over a period of time (e.g., as the system becomes familiar with the user's health conditions, his or her typical reactions to various situations, etc.). In this way, the determination of when an emergency is occurring and/or how notifications should be handled may improve over time. According to some embodiments, the decision logic includes a user confirmation action (e.g., where he or she agrees that support request messages should be transmitted) and/or a user opt-out action (e.g., where he or she must take an affirmative action to prevent the transmission of support request messages). At S230, the alert recommendation platform outputs an alert signal based on the alert recommendation (e.g., to a notification platform).

Figure 3:
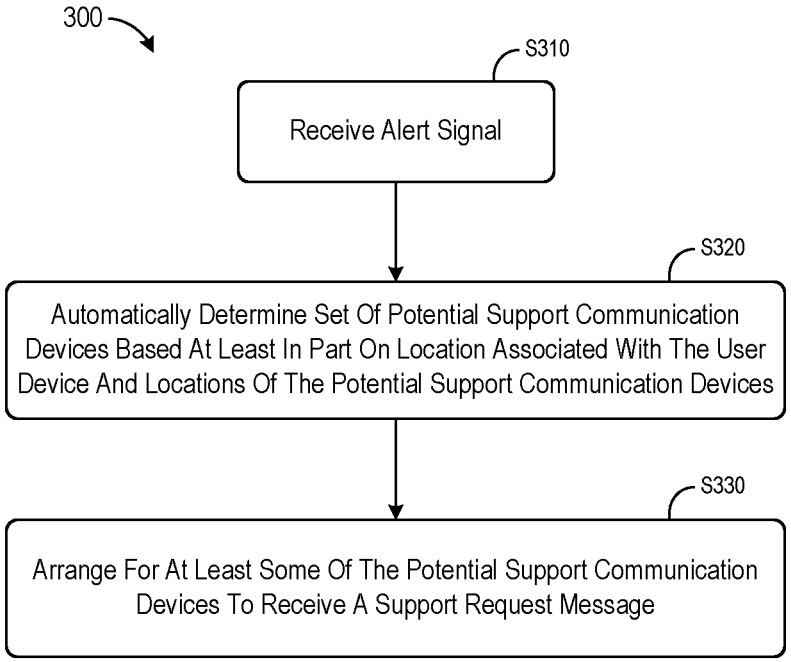
FIG. 3 is a flow diagram of a notification platform process in accordance with some embodiments.

FIG. 3 is a flow diagram of a notification platform process 300 in accordance with some embodiments. At S310, the notification platform may receive an alert signal (e.g., from an alert recommendation engine). At S320, the notification platform may automatically determine a set of potential support communication devices (e.g., nearby smartphones) based at least in part on a location associated with the user device and locations of the potential support communication devices. The location associated with the user device and/or the locations of the potential support communication devices might be based, at least in part, on GPS data, cell phone tower data, Bluetooth data, and/or location database (e.g., maintained by a third-party service). Moreover, according to some embodiments the set of potential support communication devices is determined based an absolute distance (e.g., "as-the-crow-flies"), a travel distance, and/or a time to travel a distance (e.g., including pathways, traffic and weather conditions, etc.). In some embodiments, the set of potential support communication devices and/or the notifications (or types of notifications) that are transmitted might be based at least in part on supplemental information from at least one remote data source. For example, the system may aggregate information in real time from various sources when an alert or event happens to improve decision making and/or establish efficient notification routing. In some cases, this supplemental information might also be used to determine whether or not an event has actually occurred, what types of devices should receive notifications, what information should be included in notification messages, etc.

At S330, the system may arrange for at least some of the potential support communication devices to receive a support request message. In this way, nearby individuals associated with those devices may be able to assist the user in a timely fashion. According to some embodiments, the user device and/or the potential support communication devices may also automatically notify a public emergency services platform (e.g., associated with an ambulance, fire department, police department, one or more user "in case of emergency" contact addresses, etc.).

Figure 4:
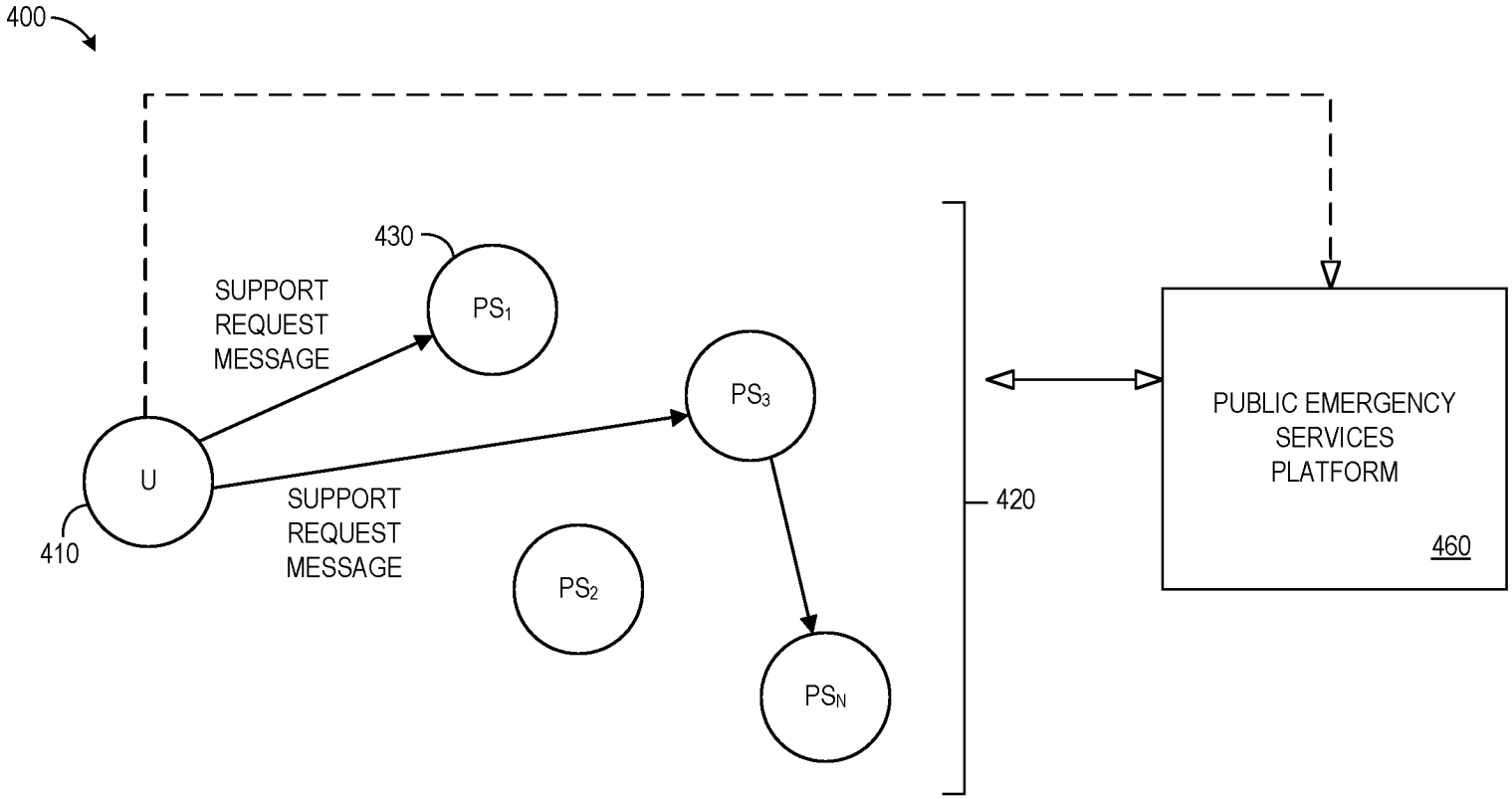
FIG. 4 illustrates a user and nearby potential support individuals according to some embodiments.

FIG. 4 illustrates 400 a user 410 ("U") and nearby potential support individuals 430 (potential supporters "$PS_1$" through "$PS_N$") according to some embodiments. In this example, when it is determined that the user 410 might require assistance, the system may automatically transmit support request messages to nearby individuals 430 $PS_1$ and $PS_2$ while not transmitting a message to $PS_N$ who is located too far away to provide timely assistance. Note that a support request message might not be transmitted to $PS_2$ (e.g., because or she opted out of an assistance providing program or did not meet certain decision logic conditions such as certification, languages spoken, etc.). According to some embodiments, $PS_3$ might also in turn transmit a message to $PS_N$ (e.g., requesting assistance on the user's behalf). In addition, according to some embodiments either the user 410 or any of the other devices 420 might exchange information with a public emergency services platform 460 (e.g., to arrange additional assistance for the user 410 as appropriate).

Figure 5:
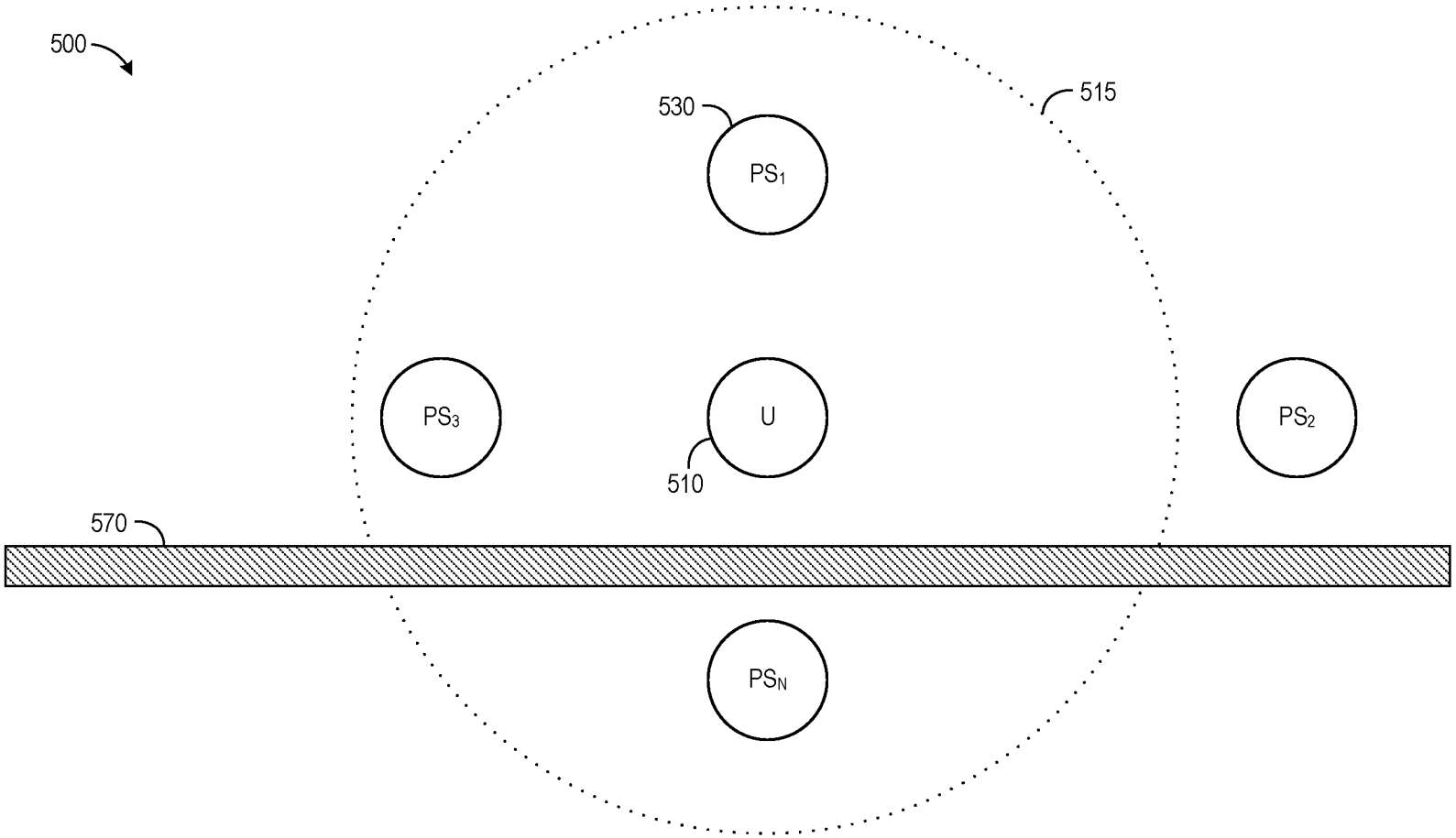
FIG. 5 illustrates how nearby potential support individuals might be selected in accordance with some embodiments.

Note that nearby individuals 430 might be automatically selected based on location information. For example, FIG. 5 illustrates 500 how nearby potential support individuals 530 (potential supporters "$PS_1$" through "$PS_N$") might be selected for user 510 ("U") in accordance with some embodiments. In this example, $PS_1$ and $PS_3$ might receive support request messages because they are within a predetermined distance radius 515 while $PS_2$ does not receive such a message because he or she is outside of that radius 515. Note that other information could also be taken into account according to some embodiments. For example $PS_N$ might not receive a support request message because a wall 570 or other obstacle might make it impractical to respond to the message (e.g., it might be unlikely that $PS_N$ would be able to reach the user 530 in a timely fashion).

Figure 6:
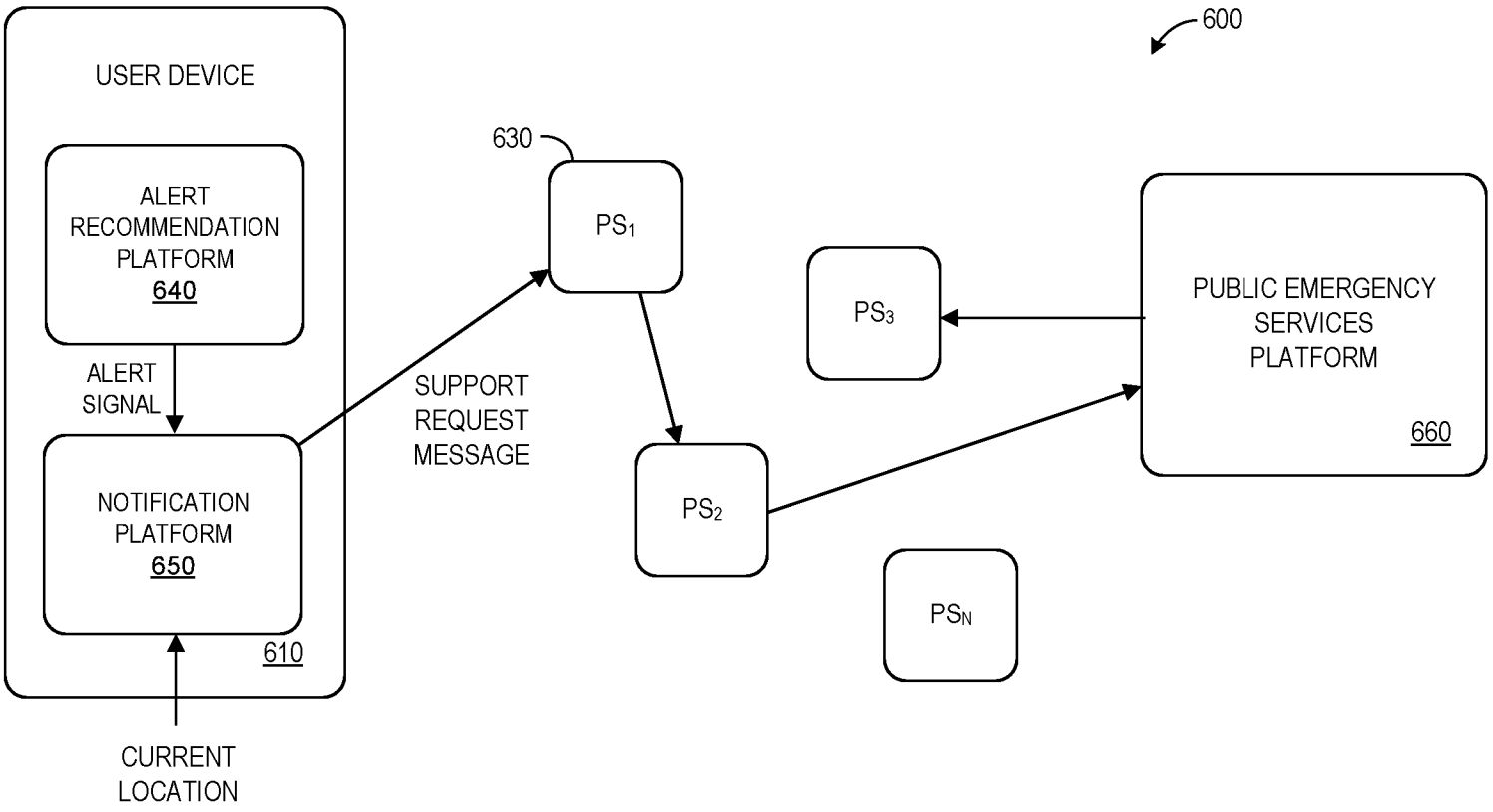
FIG. 6 is high level system diagram according to some embodiments.

According to some embodiments, both an alert recommendation platform and a notification platform are implemented as part of a user device (e.g., his or her smartphone). For example, FIG. 6 is high level system 600 diagram according to some embodiments. In this example, a user device 610 includes an alert recommendation platform 640 that automatically generates an alert signal. The alert signal might be generated, for example, based on information from one or more sensors local to the user device 610. A notification platform 650 at the user device 610 receives the alert signal from the alert recommendation platform 640 along with current location information and automatically arranges to transmit support request messages to nearby potential support communication devices 630 (associated with potential supporters "$PS_1$" through "$PS_N$"). In this example, the notification platform 650 transmits a support request message to $PS_1$ (the closest individual). Note that a system might transmit support request messages to all devices within 300 yards, only the closest five devices, etc. According to this embodiment, $PS_1$ transmits a message to $PS_2$ which, in turn, notifies a public emergency services platform 650. Note that in some embodiments, the public emergency services platform 660 might automatically arrange to contact one or more nearby individuals as appropriate (e.g., $PS_3$ as illustrated in FIG. 6).

Figure 7:
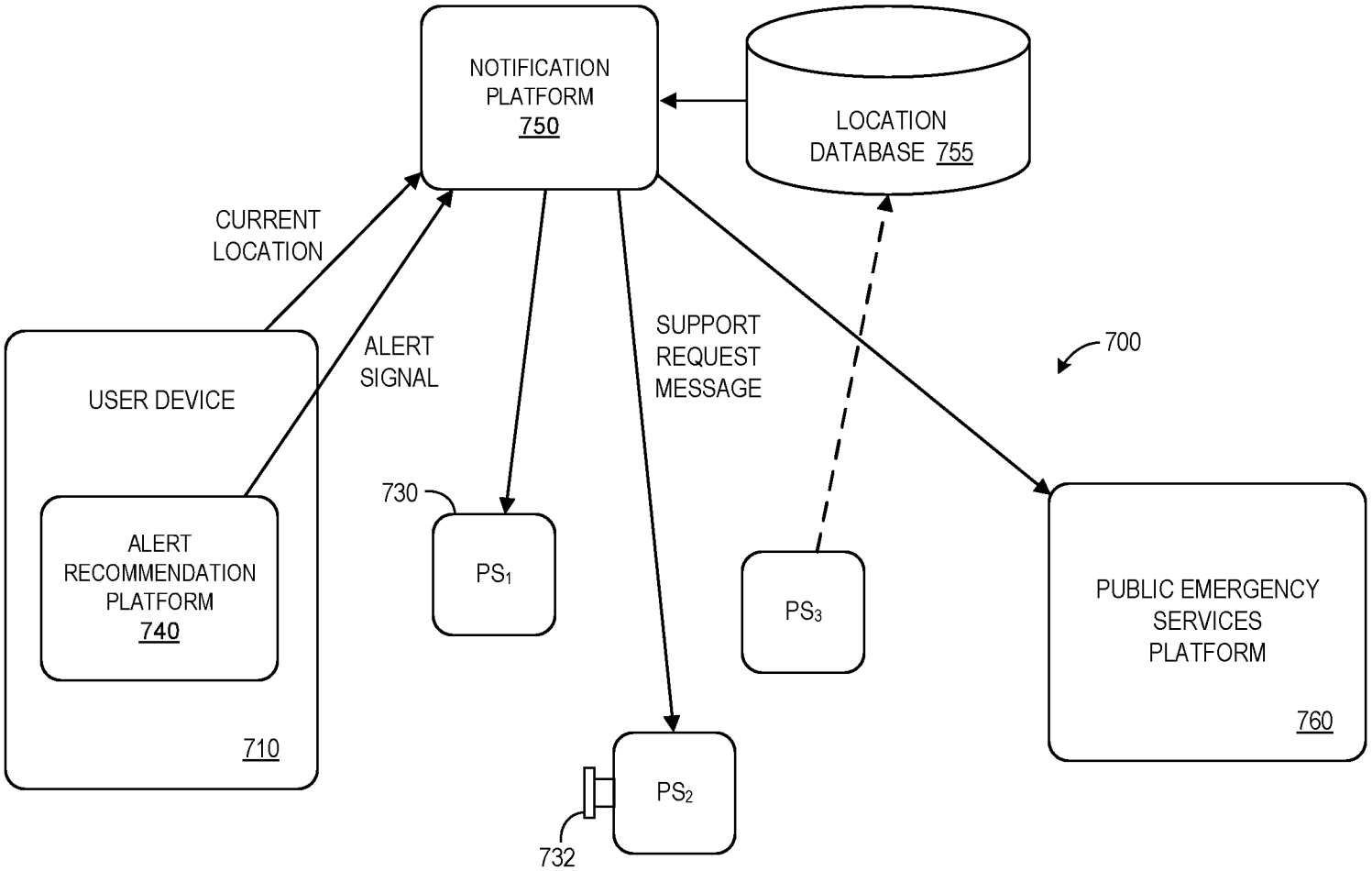
FIG. 7 is a high level system diagram having a cloud-based notification platform application in accordance with some embodiments.

According to some embodiments, at least one of the alert recommendation and the notification platform are implemented via a cloud-based application remote from the user device. For example, FIG. 7 is a high level system 700 diagram having a cloud-based notification platform application 750 in accordance with some embodiments. As before, a user device 710 includes an alert recommendation platform 740 that automatically generates an alert signal. The alert signal might be generated, for example, based on information from one or more sensors local to the user device 710. A remote cloud-based notification platform 750 may receive the alert signal from the alert recommendation platform 740 along with current location information and automatically arrange to transmit support request messages to nearby potential support communication devices 730 (associated with potential supporters "$PS_1$" through "$PS_N$"). In this example, the notification platform 750 transmits a support request message to $PS_1$ and $PS_2$ (the closest individuals) and to a public emergency services platform 760. According to some embodiment, the notification system 750 receives information from a location database 755 that stores information about nearby devices (e.g., as illustrated in FIG. 7, $PS_3$ might report a current location to the location database 755). In some embodiments, at least one of the potential support communication devices is further to record information in connection with a support request message. For example, a camera 732 associated with $PS_2$ might record information (e.g., to be provided as evidence to the police). The recorded information might include, for example, image information (e.g., a picture or video), audio information, text information, location information, etc.

Figure 8:
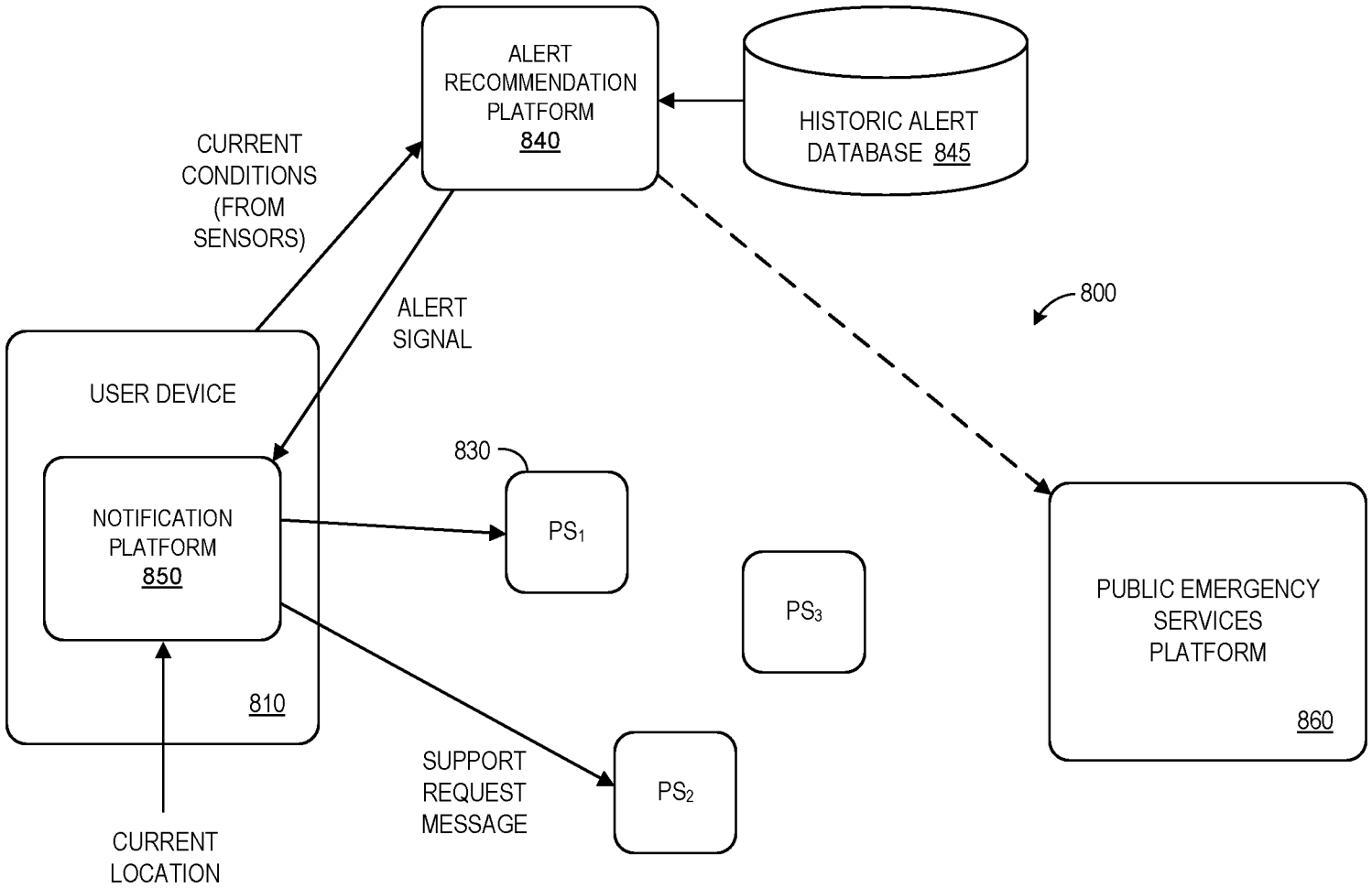
FIG. 8 is a high level system diagram having a cloud-based alert recommendation platform application in accordance with some embodiments.

FIG. 8 is a high level system 800 diagram having a cloud-based alert recommendation platform application in accordance with some embodiments. In this example, a user device 810 reports current conditions (e.g., from local sensor) to a remote cloud-based alert recommendation platform 840 that automatically generates an alert signal. The alert recommendation platform 840 might generate the alert signal, for example, based on information in a historic alert database 845 (e.g., to help the system 800 learn over time what conditions are actually associated with emergencies). According to some embodiments, the remote cloud-based alert recommendation platform 840 might also automatically alert a public emergency services platform 860. A notification platform 850 local to the user device 810 may receive the alert signal from the alert recommendation platform 840 along with current location information and automatically arrange to transmit support request messages to nearby potential support communication devices 830 (associated with potential supporters "$PS_1$" through "$PS_N$"). In this example, the notification platform 850 transmits a support request message to $PS_1$ and $PS_2$ (the closest individuals) without transmitting a message to $PS_3$ (who is too far away to provide assistance).

Figure 9:
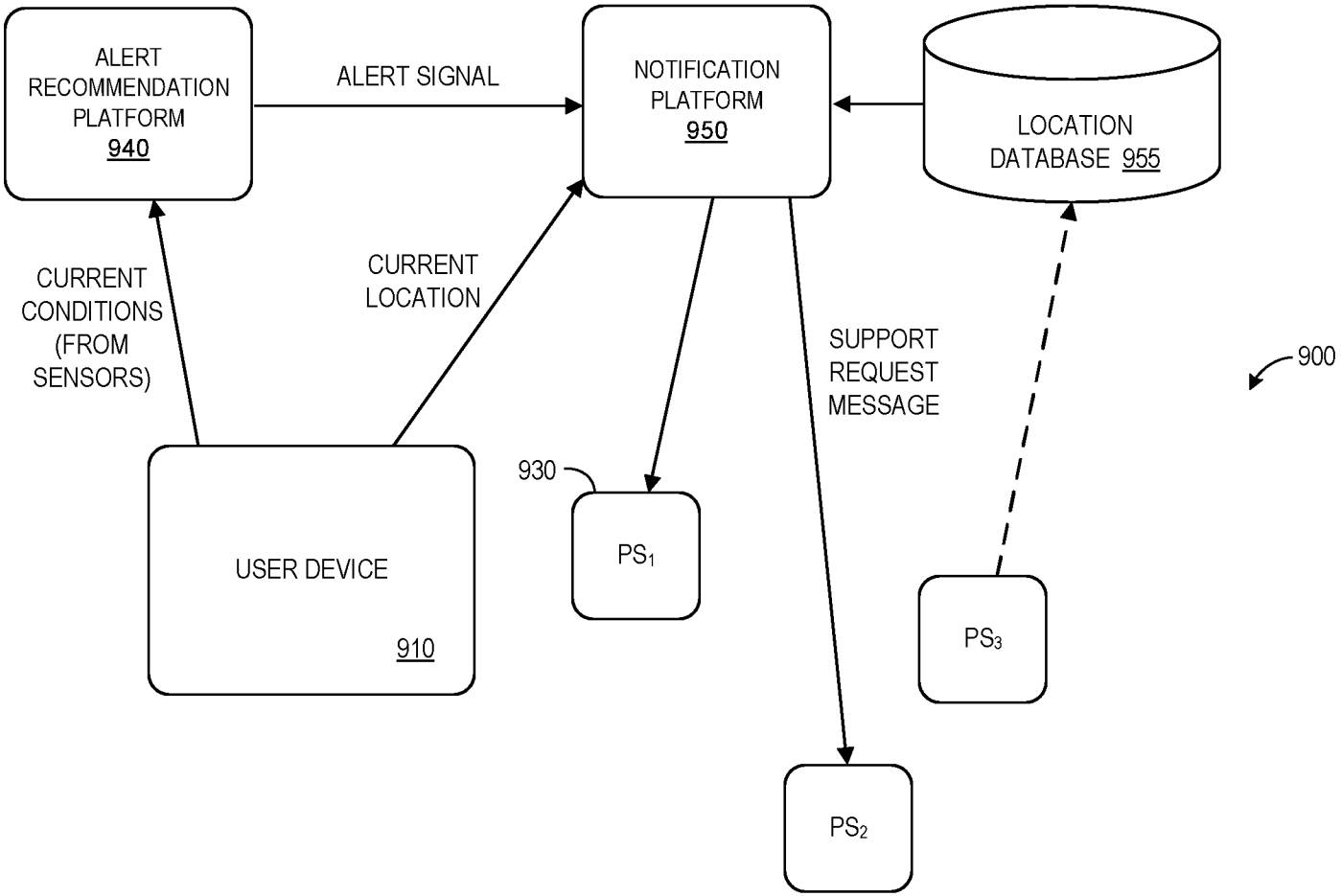
FIG. 9 is a high level system diagram having cloud-based alert recommendation platform and notification platform applications according to some embodiments.

FIG. 9 is a high level system 900 diagram having cloud-based alert recommendation platform and notification platform applications according to some embodiments. In this example, a user device 910 transmits current conditions (e.g., from local sensors) to a remote cloud-based alert recommendation platform 940 that automatically generates an alert signal. A remote cloud-based notification platform 950 may receive the alert signal from the alert recommendation platform 940 along with current location information (e.g., from the user device 91) and automatically arrange to transmit support request messages to nearby potential support communication devices 930 (associated with potential supporters "$PS_1$" through "$PS_N$"). In this example, the notification platform 950 transmits a support request message to $PS_1$ and $PS_2$ (the closest individuals). According to some embodiment, the notification system 950 receives information from a location database 955 that stores information about nearby devices (e.g., as illustrated in FIG. 9, $PS_3$ might report a current location to the location database 955).

By placing some of the processing associated with the system in a cloud-based application or service, the performance and/or battery life of the user device 910 may be improved. Moreover, the alert recommendation platform 940 and/or the notification platform 950 might utilize greater computational power as compared to a smartphone or similar device. Note that in some embodiments, the alert recommendation platform 940 and/or the notification platform 950 might be associated with an Enterprise Resource Planning ("ERP") server, a business services gateway, a HyperText Transfer Protocol ("HTTP") server, and/or an Advanced Business Application Programming ("ABAP") server. According to some embodiments, elements of the system 100 may provide connectivity to a business server, such as one associated with enterprise software (including CRM, ERP, and other backend processes) to help provide assistance to individuals in substantially real-time. In this way, the power of backend knowledge (for example at back-end application server) may be used to help an individual who is in need of assistance.

Thus, embodiments, may leverage a real-time self-learning recommendation engine (e.g., associated with an SAP® Real-Time Offer Management system) not only to identify when help should be requested from an ambulance or the police, but also to perform actions such as informing nearby people about an emergency by automatically transmitting messages to individuals in the area. Such an approach may utilize powerful real-time decision making and analytics power to provide implicit signaling by a person's device in an emergency. The device may detect a critical situation (e.g., losing consciousness in a car accident) via sensors and automatically call for help and inform people in the area. As another example, a person might break an ankle while hiking on a mountain (e.g., far from any ambulance) or get mugged on a street corner. In either case, a nearby pedestrian or car driver might provide help to if he or she know about the situation.

In some cases, a person may be in an emergency situation but be unable to call an emergency service on his own (e.g., because he or she got trapped and beaten up by a criminal, lost consciousness after falling, etc.). The acceleration sensors of a smartphone and fitness tracker, the crash sensors in an onboard car computer, etc. are just some examples of devices that could detect large force impacts or vital sign problems (e.g., pulse rate, blood pressure, etc.). In other cases, a person may be able to call for help. For example, a user device might act as a "panic" button informing both official emergency services and nearby individuals. The situation might not be dangerous for the individuals and they may be able to help immediately. In other cases, the people may be able to verify that the police have been called (and may stay in the area to later act as a helpful witness).

Note that embodiments might utilize many sources of information. For example, smartphone acceleration sensors might detect when a person falls to the ground or is beaten by an attacker. In this case, communication devices may signal nearby people while allowing them to remain at a safe distance. As another example, fitness trackers with a heart rate monitor might signal an extremely high heart rate indicating an elevated stress level or cardiac infarction. Stress levels might also be measured with skin resistance sensors integrated into fitness trackers.

Any of the recommendation platforms described herein might be installed directly on a user device or in a cloud environment. When directly installed on a user device, an engine could even work offline and analyze sensor data to match locally available historical data. When available via the cloud, an engine might provide more computing power to better analyze sensor data (and would not negatively impact device battery life).

According to some embodiments, automatic alarm detection may use techniques to reduce false positives. Such techniques might include, for example, automatic learning. Note that a recommendation engine may use historical sensor data from past actual incidents. A cloud-based application hosting this type of information may centrally collect incident data from all users. Moreover, data about every emergency (either implicitly or explicitly signaled) may be uploaded and help to improve data quality. This may allow for better pattern detection by the recommendation engine in connection with future incidents. Note, however, that having data sources hosted only in the cloud might not be feasible. For example, a device may sometimes have a weak signal to a service provider (or a data plan limit has been reached) during an incident. Thus, some embodiments may provide a local mobile recommendation engine that synchronizes identified patterns from a sensor database in the cloud whenever the device can communicate online. Such an approach may let the device still react to emergencies even when it is offline.

In some implicit signaling embodiments, a recommendation engine may continuously monitor available sensors. The engine may look for patterns of data which have been connected to emergency events in the past. If a similar pattern is detected, the recommendation engine may recommend a next best action, such as: calling an ambulance, firefighters or the police; and/or informing other nearby individuals. The recommendation engine may, for example, recommend the actions that best match previous incidents. In some explicit signaling embodiments, available historical data might not be sufficient to allow the recommendation engine to automatically detect the incident and recommend an action. In this case, a user may still be able to activate the system to manually call for help.

Figure 10:
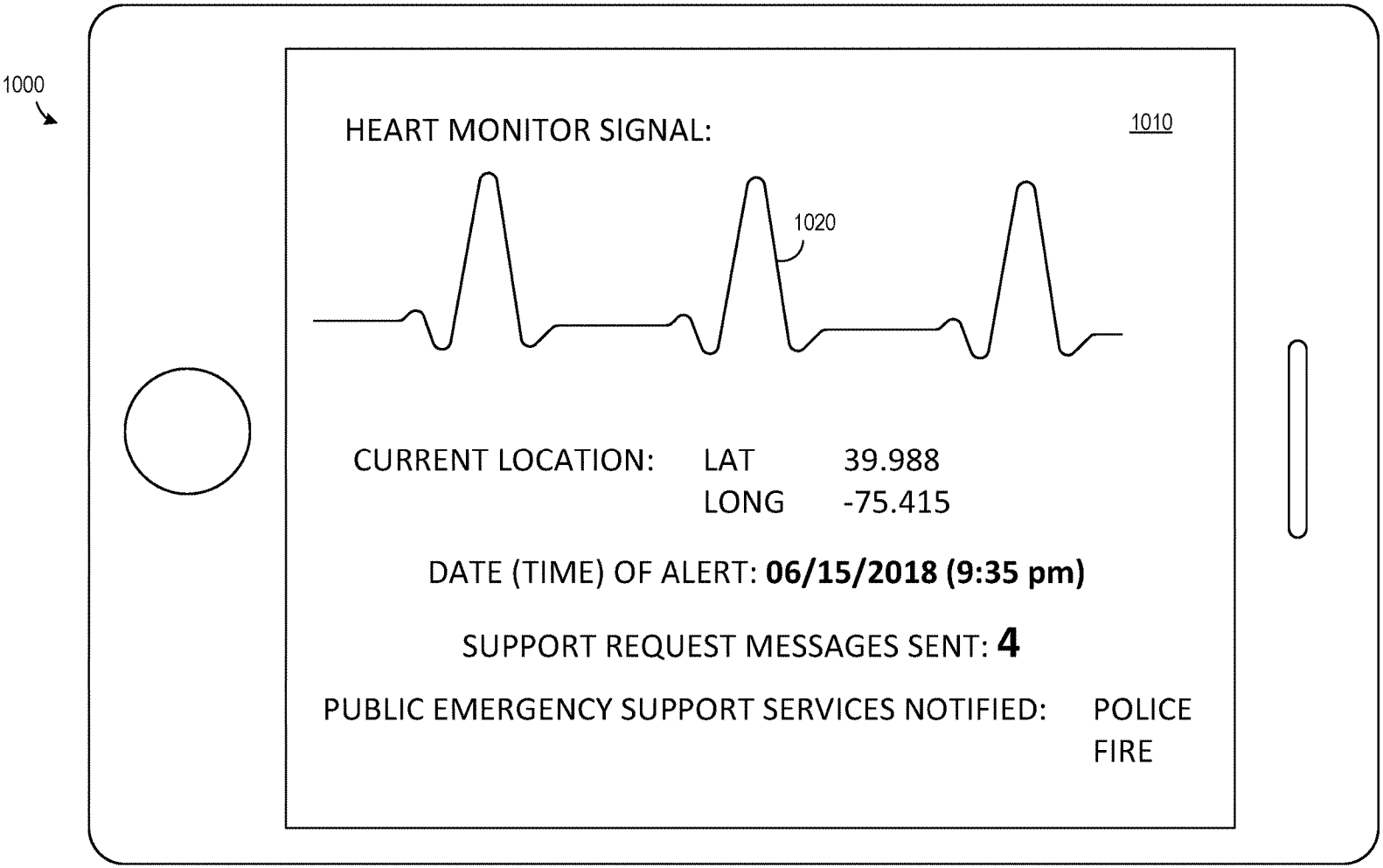
FIG. 10 is an example of a smartphone display according to some embodiments.

FIG. 10 is an example of a smartphone 1000 display 1010 according to some embodiments. The display 1010 includes a graphical representation of a current condition (heartbeat) 1020 along with a user's current location and the date/time when an alert was automatically generated. The display 1010 also includes an indication of a number of support request messages that were transmitted as a result of the alert along with a list of the public emergency support services that were notified.

Figure 11:
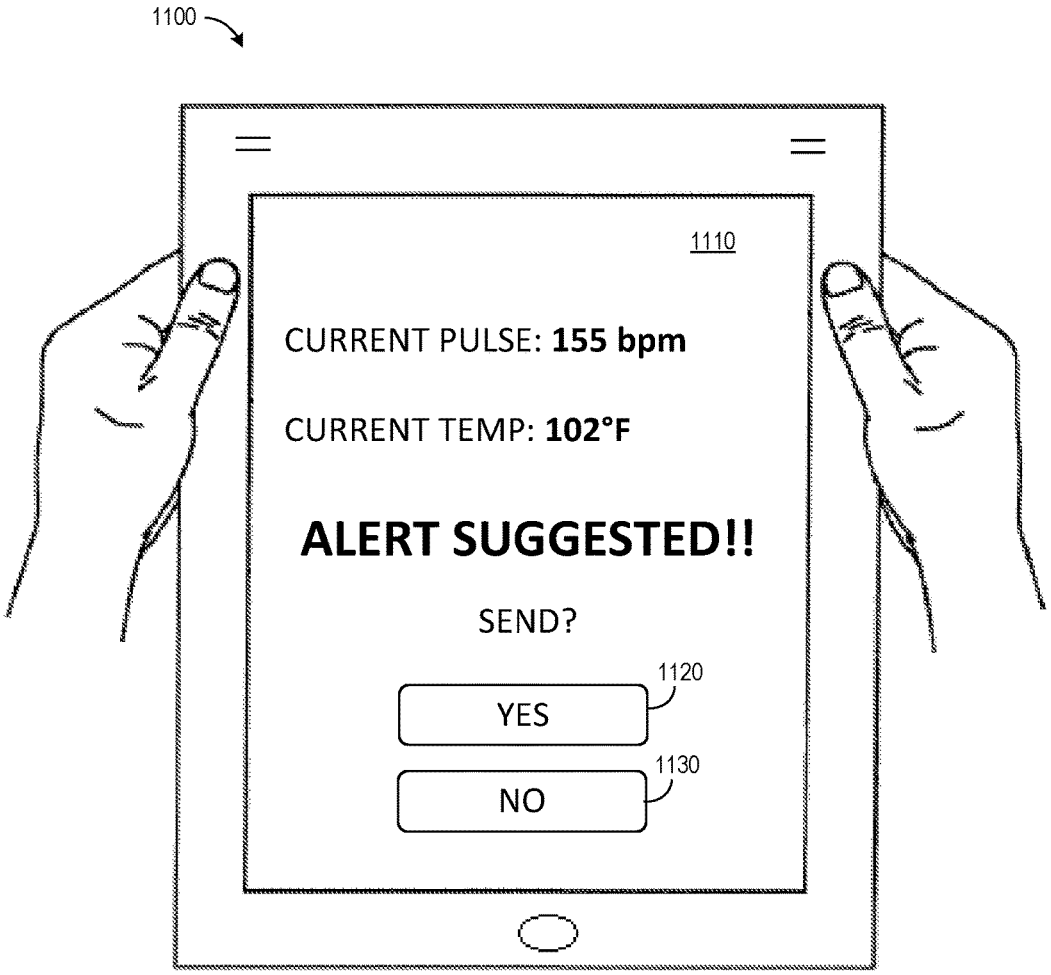
FIG. 11 is an example of a tablet computer display in accordance with some embodiments.
Figure 12:
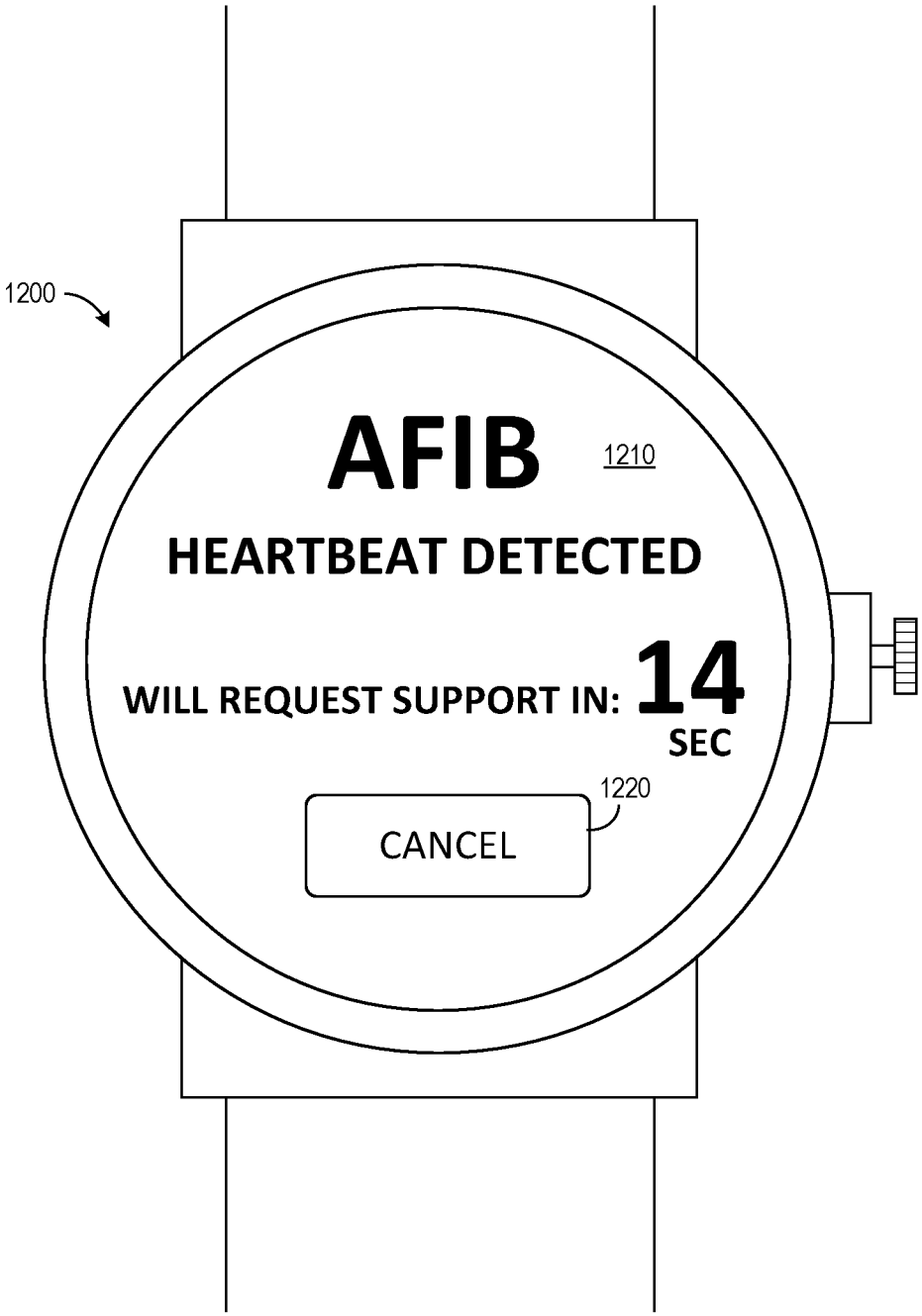
FIG. 12 is an example of a smartwatch display according to some embodiments.
Figure 13:
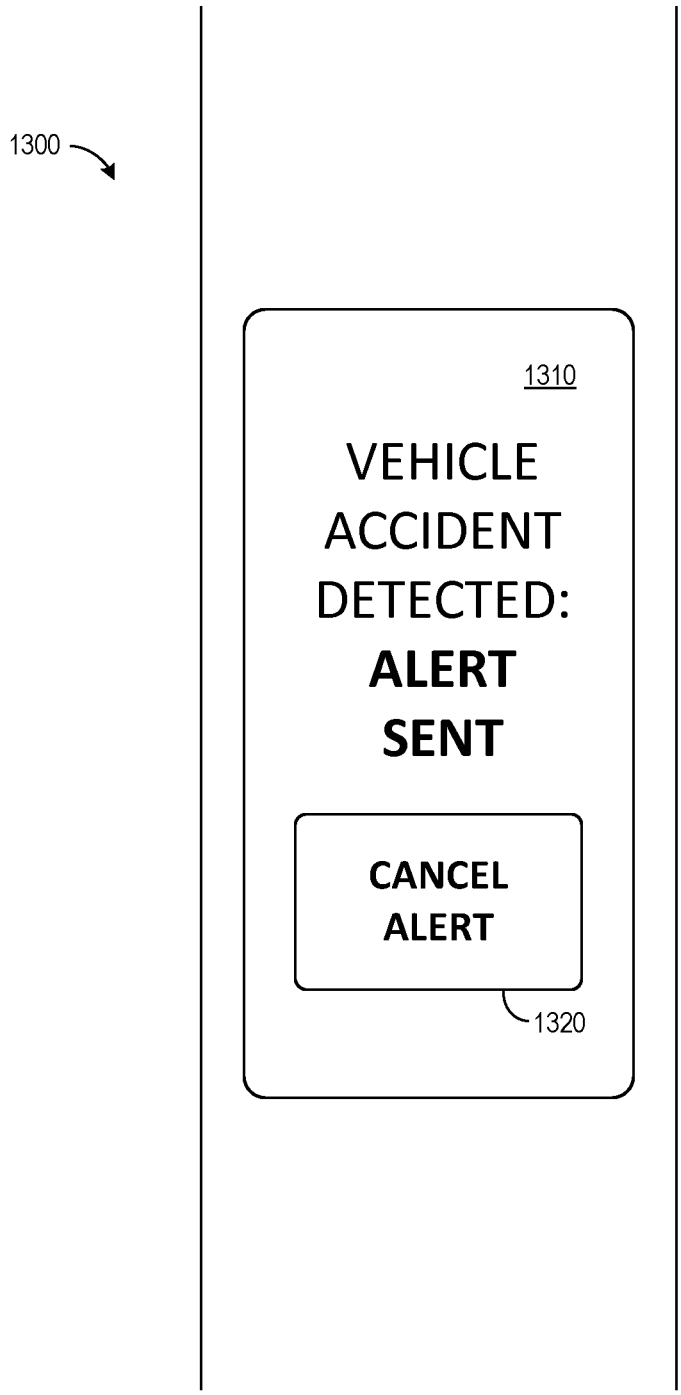
FIG. 13 is an example of an activity tracker device display in accordance with some embodiments.

Note that embodiments might be implemented via devices other than a smartphone. For example, FIG. 11 is a tablet computer 1100 display 1110 in accordance with some embodiments. The display 1110 includes information about the user's current condition (e.g., current pulse and body temperature) along with an indication that an alert has been suggested by the system. According to this embodiment, the user may affirmative elect or decline to have support request messages transmitted to nearby individuals (e.g., by selecting the "Yes" icon 1120 or "No" icon 1130 on the display 1110). As another example, FIG. 12 is a smartwatch 1200 display 1210 according to some embodiments. The display 1120 includes information about the user's current condition (e.g., a heartbeat with atrial fibrillation ("AFIB") has been detected) along with an indication that an alert has been suggested by the system. According to this embodiment, a support request message will be automatically transmitted to nearby individuals within a pre-determined period of time (e.g., which has currently counted down to 14 seconds as illustrated in FIG. 12) unless the user "opts-out" of that decision (e.g., by selecting the "Cancel" icon 1220 on the display 1210). As another example, FIG. 12 is a smartwatch 1200 display 1210 according to some embodiments. As still another example, FIG. 13 is an activity tracker device 1300 display 1310 in accordance with some embodiments. According to this embodiment, a vehicle accident has been detected and an alert (e.g., a support request message) has already been transmitted to nearby individuals. According to this embodiment, the user may still elect to cancel the alert (and the alert might be removed or deleted from nearby user devices by selection of the "Cancel Alert" icon 1320).

Figure 14:
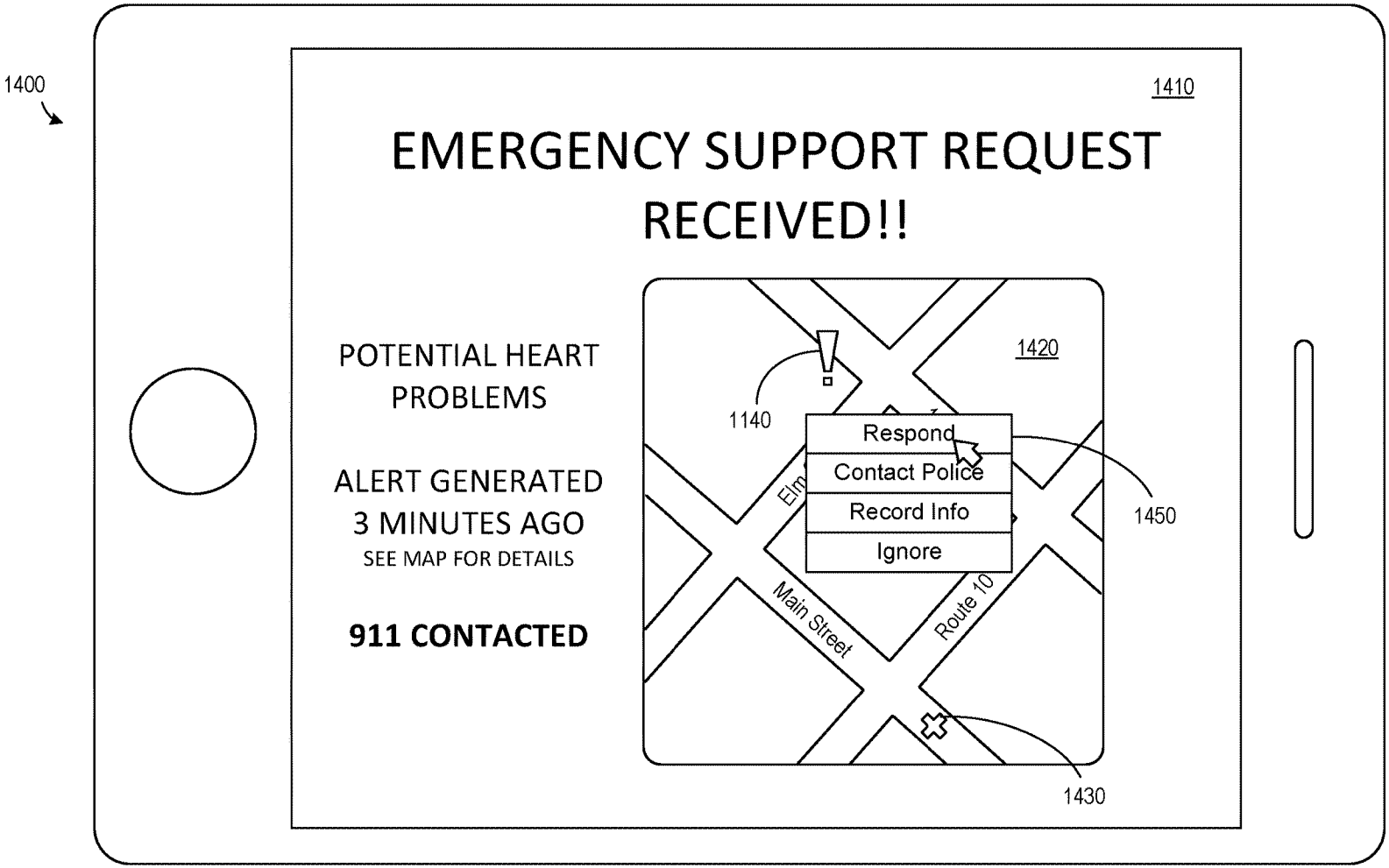
FIG. 14 is an example of a potential support individual smartphone display according to some embodiments.

In addition to provide a display to a user in need of assistance, embodiments may also provide displays to nearby individuals via their communication devices. For example, FIG. 14 is an example of a potential support individual smartphone 1400 display 1410 according to some embodiments. The display 1410 alerts the individual that a nearby user needs assistance along with a brief explanation as to the possible cause of the emergency (e.g., heart problems), how long ago the alert was generated, and an indication as to whether or not emergency support services have also been contact. The display 1410 further includes a map portion 1420 with a current location icon 1430 (an "X") and an alert location icon 1440 (an exclamation point). The map portion 1420 may be used by the individual to respond 1450 to the alert (e.g., by indicating that he or she will respond, contact police, record information, ignore, etc.) as well as help guide him or her to the nearby user in distress so that assistance may be provided.

Figure 15:
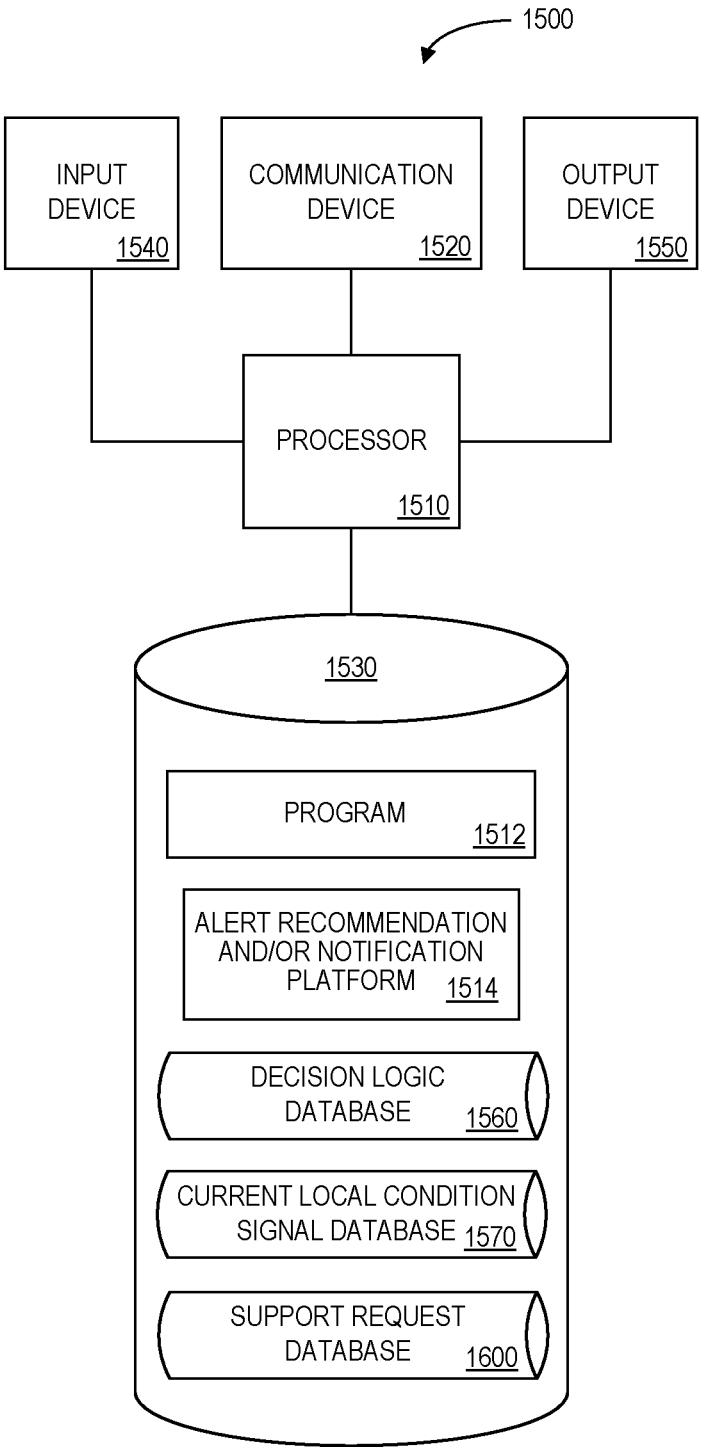
FIG. 15 is a block diagram of an apparatus according to some embodiments.

Accordingly, methods and mechanisms to efficiently, accurately, and/or automatically facilitate location based support request messages responsive to alert recommendations may be provided in accordance with some embodiments described herein. Note that the techniques described with respect to FIGS. 1 through 14 might be implemented using any of a number of different types of hardware. For example FIG. 15 is a block diagram overview of an apparatus 1500 according to some embodiments. The apparatus 1500 may be, for example, associated with a mobile user device, such as a smartphone or tablet computer. The apparatus 1500 comprises a processor 1510, such as one or more commercially available Central Processing Units ("CPUs") in the form of one-chip microprocessors, coupled to a communication device 1520 configured to communicate via a communication network (not shown in FIG. 15). The communication device 1520 may be used, for example, to exchange information with nearby user devices, remote cloud-based applications, etc. The apparatus 1500 further includes an input device 1540 (e.g., a touchscreen to enter information about a user's response to a suggest alert) and an output device 1550 (e.g., a touchscreen display to provide alert information to a user).

The processor 1510 communicates with a storage device 1530. The storage device 1530 may comprise any appropriate information storage device, including combinations of magnetic storage devices (e.g., a hard disk drive), optical storage devices, and/or semiconductor memory devices. The storage device 1530 stores a program 1512 and an alert recommendation and/or notification platform/engine 1514 for controlling the processor 1510. The processor 1510 performs instructions of the programs 1512, 1514, and thereby operates in accordance with any of the embodiments described herein. For example, the processor 1510 may receive signals indicative of current conditions local at a user device (e.g., a smartphone) from a set of condition monitoring sensors. The processor 1510 may automatically analyze the signals and decision logic to generate an alert recommendation and output an alert signal. Responsive to the alert signal, the processor 1510 may automatically determine a set of potential support communication devices (e.g., other smartphones) based at least in part on a location associated with the user device and locations of the potential support communication devices. The processor 1510 may then arrange for at least some of the potential support communication devices to receive a support request message (e.g., nearby smartphones may receive notification messages requesting support).

The programs 1512, 1514 may be stored in a compressed, uncompiled and/or encrypted format. The programs 1512, 1514 may furthermore include other program elements, such as an operating system, a database management system, and/or device drivers used by the processor 1510 to interface with peripheral devices.

As used herein, information may be "received" by or "transmitted" to, for example: (i) the apparatus 1500 from another device; or (ii) a software application or module within the apparatus 1500 from another software application, module, or any other source.

In some embodiments (such as shown in FIG. 15), the storage device 1530 stores a decision logic database 1560 (e.g., storing rules and conditions about when an alert signal is appropriate), a current local condition database 1570 (e.g., storing information measured by local sensors), and a support request database 1600 (e.g., including information about support request messages that have been suggested, transmitted, responded to, etc.). An example of a support request database 1600 that may be used in connection with the apparatus 1500 will now be described in detail with respect to FIG. 16. Note that the database described herein is only an example, and additional and/or different information may be stored therein. Moreover, various databases might be split or combined in accordance with any of the embodiments described herein.

Referring to FIG. 16, a table is shown that represents the support request database 1600 that may be stored at the apparatus 1500 according to some embodiments. The table may include, for example, entries identifying support request messages that have been suggested, transmitted, responded to, etc. The table may also define fields 1602, 1604, 1606, 1608, 1610 for each of the entries. The fields 1602, 1604, 1606, 1608, 1610 may, according to some embodiments, specify: a support request message identifier 1602, sensors 1604, a description 1606, a location 1608, and potential support communication devices 1610. The information in the support request database 1600 may be created and updated, for example, when the system automatically generates an alert signal and recommends that a support request message be transmitted to nearby individuals.

The support request message identifier 1602 may be, for example, a unique alphanumeric code identifying a support request message that has been, or may be, transmitted to nearby individual. The sensors 1604 may indicate one or more sensors that provide signals indicative of a current condition local at a user device (e.g., that reflect his or her health, wellbeing, etc.). The description 1606 might reflect when the support request message was generated and the location 1608 might define his or location when the alert signal was generated (e.g., which may be used to determine nearby individuals and/or communication devices). The potential support communication devices 1610 might comprise a list of descriptions or identifiers associated with nearby individuals who received the support message request.

Thus, some embodiments may establish methods and mechanisms to efficiently, accurately, and/or automatically facilitate location based support request messages responsive to alert recommendations. The following illustrates various additional embodiments and do not constitute a definition of all possible embodiments, and those skilled in the art will understand that the present invention is applicable to many other embodiments. Further, although the following embodiments are briefly described for clarity, those skilled in the art will understand how to make any changes, if necessary, to the above-described apparatus and methods to accommodate these and other embodiments and applications.

While embodiments have been illustrated using particular types of tables and databases, embodiments may be implemented in any other of a number of different ways. For example, some embodiments might be associated with publically available information, such as weather or traffic information available via web sites.

Moreover, any of the embodiments described herein may incorporate business intelligence and/or smart learning systems to help optimize responses according to real time data from users. Such types of valuable business information may better serve customers and/or help an organization improve service quality. Similarly, embodiments may provide analysis and prediction abilities and/or let a user inform the system about unusual situations. For example, a user might inform the system that he or she was not experiencing an emergency even though the sensor data was unusual (e.g., he or she might have been on a rollercoaster ride at an amusement park).

Embodiments have been described herein solely for the purpose of illustration. Persons skilled in the art will recognize from this description that embodiments are not limited to those described, but may be practiced with modifications and alterations limited only by the spirit and scope of the appended claims.

What is claimed is:

1. A system, comprising:

a set of condition monitoring sensors, each condition monitoring sensor being adapted to provide a signal indicative of a current condition local at a user device;

an alert recommendation platform, including:

a sensor communication port to receive data associated with the current condition signals from the set of condition monitoring sensors, and an alert recommendation platform computer adapted to:

(i) receive the data associated with the current local condition signals from the set of condition monitoring sensors, (ii) automatically analyze the received data and decision logic to generate an alert recommendation, and (iii) output an alert signal based on the alert recommendation; and a notification platform, including:

a recommendation communication port to receive the alert signal from the alert recommendation platform, and a notification platform computer adapted to:

(iv) receive the alert signal, (v) automatically determine a location for each potential support communication device, wherein a set of potential support communication devices is determined based at least in part on at least one of: (i) a travel distance and (ii) a time to travel distance;

(vi) automatically determine the set of potential support communication devices based at least in part on a location associated with the user device and the determined location for each of the potential support communication devices, wherein the set is unknown prior to receipt of the alert signal, wherein the set of potential support communication devices is automatically determined based on a logic condition associated with a user of the potential support communication device; and (vii) arrange for at least some of the potential support communication devices to receive a support request message.

2. The system of claim 1, wherein the alert recommendation platform and the notification platform are implemented as part of the user device.

3. The system of claim 1, wherein at least one of the alert recommendation and the notification platform are implemented via a cloud-based application remote from the user device.

4. The system of claim 1, wherein the decision logic is based on at least one of: (i) historic information associated with other user devices, and (ii) past interactions with the user device.

5. The system of claim 1, wherein the decision logic includes at least one of: (i) a user confirmation action, and (ii) a user opt-out action.

6. The system of claim 1, wherein the set of potential support communication devices is further determined based in part on: (i) an absolute distance, and (ii) supplemental information from at least one remote data source.

7. The system of claim 1, wherein at least one condition monitoring sensor is associated with at least one of: (i) a smartphone, (ii) an activity or fitness tracker, (iii) a smartwatch, (iv) a wearable computing device, (v) a vehicle computer, (vi) a motion sensor, (vii) an accelerometer, (viii) a heart rate monitor, (ix) a blood pressure monitor, (x) a glucose level monitor, (xi) skin resistance, (xii) a body temperature thermometer, (xiii) a microphone, (xiv) a location device, or (xv) any other diagnostic tool or device.

8. The system of claim 1, wherein the user device is associated with at least one of: (i) a smartphone, (ii) an activity sensor, (iii) a smartwatch, (iv) a wearable computing device, (v) a game or entertainment device, (vi) a music player, and (vii) a vehicle computer.

9. The system of claim 1, wherein at least one of the user device and the potential support communication devices are further to notify a public emergency services platform.

10. The system of claim 1, wherein at least one of the potential support communication devices is further to record information in connection with the support request message.

11. The system of claim 10, wherein the recorded information comprises at least one of: (i) image information, (ii) a picture, (iii) video information, (iv) audio information, (v) text information, and (vi) location information.

12. The system of claim 10, wherein at least one of the location associated with the user device and the locations of the potential support communication devices is associated with at least one of: (i) global positioning system satellite data, (ii) cell phone tower data, (iii) Bluetooth data, and (iv) a location database.

13. A computer implemented method, comprising:

receiving data associated with current local condition signals from a set of condition monitoring sensors, each condition monitoring sensor being adapted to provide a signal indicative of a current condition local at a user device;

automatically analyzing, by an alert recommendation platform computer, the received data and decision logic to generate an alert recommendation;

automatically determining a location for each potential support communication device, wherein the location is based on at least one of (i) a travel distance and (ii) a time to travel a distance;

responsive to the alert recommendation, automatically determining, by a notification platform computer, a set of potential support communication devices based at least in part on a location associated with the user device and the determined location for each of the potential support communication devices, wherein the set is unknown prior to receipt of the alert recommendation;

wherein the set of potential support communication devices is automatically determined based on a logic condition associated with a user of the potential support communication device; and arranging for at least some of the potential support communication devices to receive a support request message.

14. The method of claim 13, wherein the alert recommendation platform and the notification platform are implemented as part of the user device.

15. The method of claim 13, wherein at least one of the alert recommendation and the notification platform are implemented via a cloud-based application remote from the user device.

16. The method of claim 13, wherein the decision logic is based on historic information associated with other user devices.

17. The method of claim 13, wherein the decision logic includes at least one of: (i) a user confirmation action, and (ii) a user opt-out action.

18. A non-transitory, computer-readable medium storing program code executable by a computer processor to perform a method, the method comprising:

receiving data associated with current local condition signals from a set of condition monitoring sensors, each condition monitoring sensor being adapted to provide a signal indicative of a current condition local at a user device;

automatically analyzing, by an alert recommendation platform computer, the received data and decision logic to generate an alert recommendation;

automatically determining a location for each potential support communication device, wherein the location is based on at least one of (i) a travel distance and (ii) a time to travel a distance;

responsive to the alert recommendation, automatically determining, by a notification platform computer, a set of potential support communication devices based at least in part on a location associated with the user device and the determined location for each of the potential support communication devices, wherein the set is known prior to receipt of the alert recommendation;

wherein the set of potential support communication devices is automatically determined based on a logic condition associated with a user of the potential support communication device; and arranging for at least some of the potential support communication devices to receive a support request message.

19. The medium of claim 18, wherein at least one condition monitoring sensor is associated with at least one of: (i) a smartphone, (ii) an activity sensor, (iii) a smartwatch, (iv) a wearable computing device, (v) a vehicle computer, (vi) a motion sensor, (vii) an accelerometer, (viii) a heart rate monitor, (ix) a blood pressure monitor, (x) a glucose level monitor, (xi) skin resistance, (xii) a microphone, and (xiii) a location device.

20. The medium of claim 18, wherein the user device is associated with at least one of: (i) a smartphone, (ii) an activity sensor, (iii) a smartwatch, (iv) a wearable computing device, (v) a game or entertainment device, (vi) a music player, and (vii) a vehicle computer.

21. The medium of claim 18, wherein at least one of the user device and the potential support communication devices are further to notify a public emergency services platform, and further wherein at least one of the potential support communication devices is further to record information in connection with the support request message.

* * * * *